US011011101B2

(12) United States Patent
Zhang et al.

(10) Patent No.: US 11,011,101 B2
(45) Date of Patent: May 18, 2021

(54) METHOD AND ELECTRONIC DEVICE FOR CONTROLLING DISPLAY DEVICE BASED ON COLOR PERCEIVED BRIGHTNESS

(71) Applicant: NOVATEK Microelectronics Corp., Hsin-Chu (TW)

(72) Inventors: Xiao Zhang, Xi'an (CN); Danyu Fu, Xi'an (CN); Yuanjia Du, Jinan (CN); Jianhua Liang, Xi'an (CN); Qiqiang Han, Xi'an (CN)

(73) Assignee: NOVATEK Microelectronics Corp., Hsin-Chu (TW)

( * ) Notice: Subject to any disclaimer, the term of this patent is extended or adjusted under 35 U.S.C. 154(b) by 165 days.

(21) Appl. No.: 15/985,611

(22) Filed: May 21, 2018

(65) Prior Publication Data

US 2019/0347975 A1 Nov. 14, 2019

(30) Foreign Application Priority Data

May 10, 2018 (CN) ..... 201810443771.6

(51) Int. Cl.
*G09G 3/20* (2006.01)

(52) U.S. Cl.
CPC ..... *G09G 3/2074* (2013.01); *G09G 3/2003* (2013.01); *G09G 2320/0233* (2013.01); *G09G 2320/0242* (2013.01); *G09G 2320/0666* (2013.01)

(58) Field of Classification Search
CPC ..... G09G 3/2003; G09G 2320/0233; G09G 2320/0242; G09G 2320/0666
See application file for complete search history.

(56) References Cited

U.S. PATENT DOCUMENTS

2006/0098077 A1* 5/2006 Dowling ..... H05B 37/02 347/130
2008/0068293 A1* 3/2008 Ishii ..... G09G 3/20 345/3.1
2009/0002561 A1* 1/2009 Barnhoefer ..... G09G 3/3406 348/655
2010/0103201 A1* 4/2010 Nakanishi ..... G09G 3/2003 345/690
2012/0120096 A1* 5/2012 Johnson ..... G09G 3/2048 345/596

* cited by examiner

*Primary Examiner* — Wing H Chow
(74) *Attorney, Agent, or Firm* — Winston Hsu

(57) ABSTRACT

A method of controlling a display device is disclosed including receiving a plurality of sub-pixel values for a target pixel among a plurality of pixels of an image frame, wherein the sub-pixel values of the target pixel comprise red, green, and blue sub-pixel values; calculating a pixel-based boosting ratio corresponding to the target pixel according to the sub-pixel values of the target pixel; and adjusting at least one of a plurality of backlight duties associated with the target pixel and the plurality of sub-pixel values of the target pixel according to the pixel-based boosting ratio.

30 Claims, 8 Drawing Sheets

METHOD AND ELECTRONIC DEVICE FOR CONTROLLING DISPLAY DEVICE BASED ON COLOR PERCEIVED BRIGHTNESS

BACKGROUND OF THE INVENTION

1. Field of the Invention

The present invention relates to a method and electronic device for controlling a display device based on color perceived brightness.

2. Description of the Prior Art

Perceived brightness induced by two color stimuli to human eyes may be different. For example, the Helmholtz-Kohlrausch (abbreviated HK) effect is the phenomenon in which two color stimuli to human eyes have the same luminance but different chromaticity in a certain hue, so the perceived brightness induced by the two stimuli to human eyes are different.

Researches show that the perceived brightness (or, chromatic luminance) increases as the saturation increases. The color corresponding to a small HK value (such as yellow and cyan) may look dull and have terrible perceived performance compared to other colors, while the color corresponding to a high HK value (such as reds, pinks, magentas, and blues) may look stronger than other colors.

Moreover, an RGBW (Red-Green-Blue-White) display device is known to result in higher light transmission. However, when pixels of an image frame with RGB (Red-Green-Blue) format are converted into RGBW format, the reduced aperture for red, green and blue sub-pixel values may lead to reduced luminance of saturated pixels. Consequently, colorful images may appear dull due to the lack of sufficient luminance. What is more, the color corresponding to the small HK value (such as yellow and cyan) such as yellow and cyan will have more terrible performance compared to other colors.

Therefore, there is a need to adjust backlight duties of the display device based on the Helmholtz-Kohlrausch effect to improve perceived performance.

SUMMARY OF THE INVENTION

It is therefore an objective of the present invention to provide a method and electronic device for controlling a display device, and more particularly to a method and electronic device for controlling a display device based on color perceived brightness.

One aspect of the present invention discloses a method of controlling a display device. The method includes receiving a plurality of sub-pixel values for a target pixel among a plurality of pixels of an image frame, wherein the sub-pixel values of the target pixel comprise red, green, and blue sub-pixel values; calculating a pixel-based boosting ratio corresponding to the target pixel according to the sub-pixel values of the target pixel; and adjusting the backlight duty associated with the target pixel and the plurality of sub-pixel values of the target pixel according to the pixel-based boosting ratio.

Another aspect of the present invention further discloses an electronic device for controlling a display device. The electronic device includes a processing device, and a memory device coupled to the processing device and configured to store a program code to instruct the processing device to perform a process for controlling the display device, wherein the process comprises steps of the method of controlling a display device as abovementioned.

The display control circuit of the embodiments receives the sub-pixel values with (R,G,B) of the target pixel among a plurality of pixels of one image frame, calculates the pixel-based boosting ratio corresponding to the target pixel according to the sub-pixel values (R,G,B) of the target pixel by involving a human eye sensing capability parameter corresponding to the sub-pixel values (R,G,B) of the target pixel, and adjusts at least one of the of the backlight duty and the sub-pixel values of the target pixel according to the pixel-based boosting ratio. Therefore, the display control circuit of the embodiments can improve the perceived performance of the display device.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
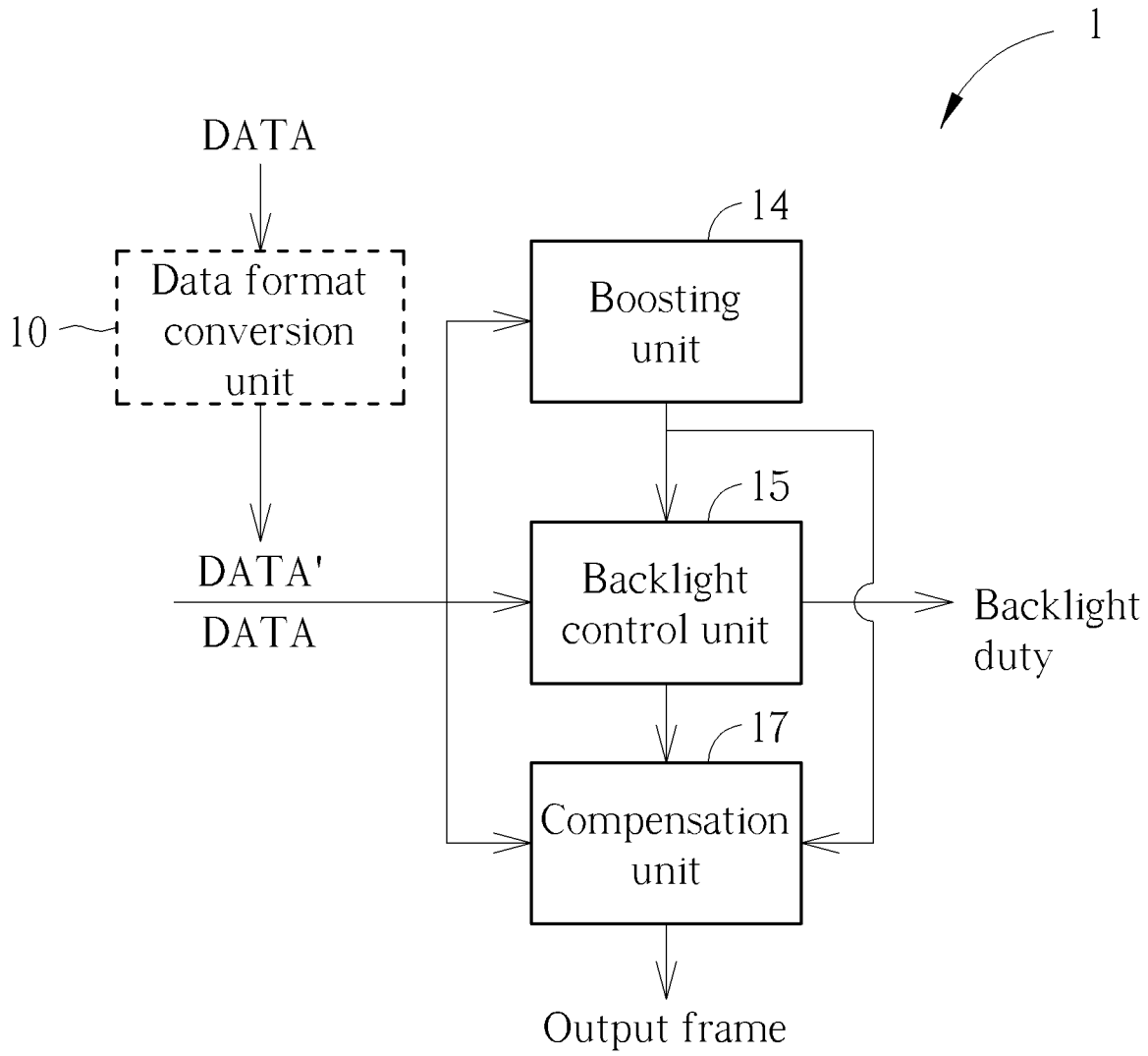
FIG. 1A is a functional block diagram of a display control circuit according to an embodiment of the present invention.

FIG. 1A is a functional block diagram of a display control circuit 1 according to an embodiment of the present invention. The display control circuit 1 can be used for controlling a display device, such as an RGBW (Red-Green-Blue-White) display device or a RGB (Red-Green-Blue) display device. The display control circuit 1 includes a data format conversion unit 10, a boosting unit 14, a backlight control unit 15, and a compensation unit 17.

The data format conversion unit 10 is configured to convert an image frame DATA with a first format (e.g., RGB format) into a converted image frame DATA' with a second format (e.g., RGBW format). In one embodiment, the data format conversion unit 10 may be excluded from the display control circuit 1 if it is used for controlling an RGB display device.

The boosting unit 14 is coupled to the data format conversion unit 10, the backlight control unit 15 and the compensation unit 17, and configured to generate a plurality of pixel-based boosting ratios to the backlight control unit 15 and the compensation unit 17 according to at least one of the image frame DATA and the converted image frame DATA'. The image frame DATA (or the converted image frame DATA') includes a plurality of pixels corresponding to the plurality of pixel-based boosting ratios.

The backlight control unit 15 is coupled to the data format conversion unit 10, the boosting unit 14 and the compensation unit 17, and configured to generate a backlight duty according to the plurality of pixel-based boosting ratios and at least one of the image frame DATA and the converted image frame DATA'.

The compensation unit 17 is coupled to the boosting unit 14 and the backlight control unit 15, and configured to compensate the image frame DATA (or the converted image frame DATA') by a plurality of pixel-based gains, respectively, so as to output an output image frame corresponding to the input image frame DATA. The compensation unit 17 is further configured to calculate the plurality of pixel-based gains according to the plurality of pixel-based boosting ratios, wherein detailed operation of the compensation unit 17 is described in the following description.

Figure 1B:
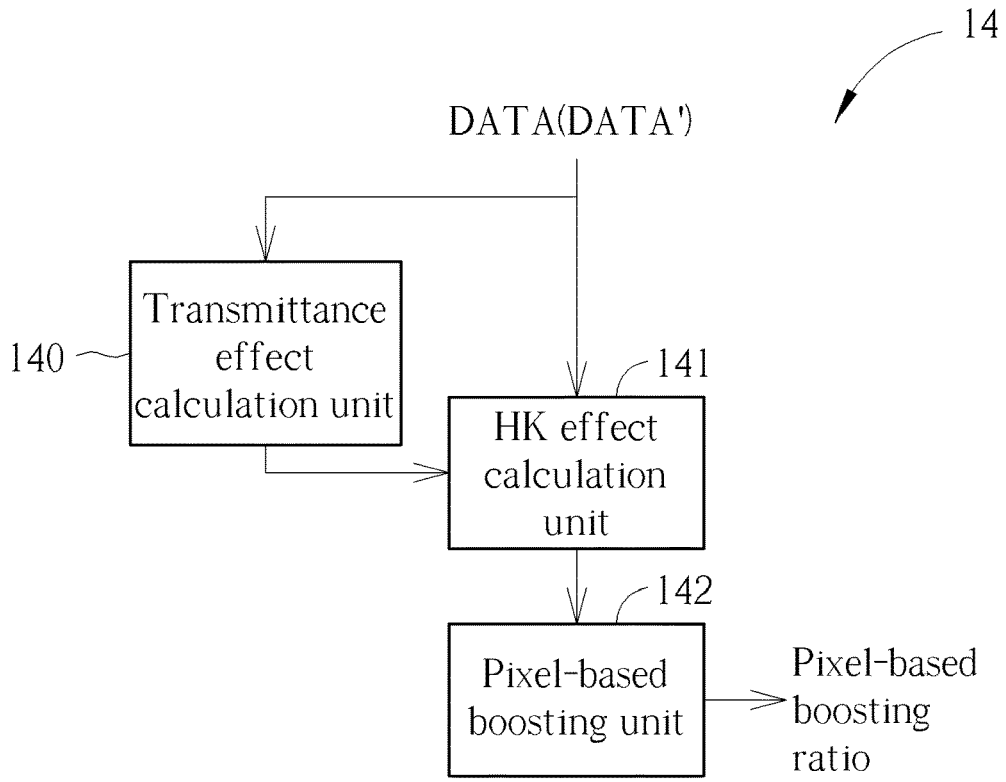
FIG. 1B is a functional block diagram of the boosting unit in FIG. 1 according to an embodiment of the present invention.

FIG. 1B is a functional block diagram of the boosting unit 14 in FIG. 1 according to an embodiment of the present invention. In one embodiment, the boosting unit 14 may not be integrated with the display control circuit 1.

In some embodiments, the boosting unit 14 includes a human eye sensing capability calculation unit such as an HK (Helmholtx-Kohklrausch) effect calculation unit 141 and a pixel-based boosting unit 142, which configured to calculate the plurality of pixel-based boosting ratios corresponding to a plurality of pixels of a target block B_J of a plurality of blocks B_1-B_K based on a plurality of HK effect parameters provided by the HK effect calculation unit 141. The image frame DATA (or the converted image frame DATA') is divided into the plurality of blocks B_1-B_K.

In other embodiments, the boosting unit 14 further includes a transmittance effect calculation unit 140, and the pixel-based boosting unit 142 is configured to calculate the plurality of pixel-based boosting ratios corresponding to a plurality of pixels of the target block B_J of the blocks B_1-B_K further based on a transmittance effect parameter provided by the transmittance effect calculation unit 140. The transmittance effect calculation unit 140 may be excluded from the boosting unit 14 if the display control circuit 1 is used for controlling an RGB display device.

The transmittance effect calculation unit 140 is coupled to the pixel-based boosting unit 142, and configured to calculate a transmittance effect parameter corresponding to a target pixel of the target block B_J according to sub-pixel values (r,g,b,w) with the second format and sub-pixel values (R,G,B) with the first format of the target pixel.

Given that the backlight luminance of the RGBW display device is half of the backlight luminance of the RGB display device (namely, the backlight luminance of the RGB display device is double of the backlight luminance of the RGBW display device), and a pixel with the maximum luminance (e.g., white) of the RGB display device is mapped to a pixel with the maximum luminance (e.g., white) of the RGBW display device. Moreover, given that the backlight luminance of a pixel with sub-pixel values rgbw(1,1,1,0) is equivalent to the backlight luminance of a pixel with sub-pixel values rgbw(0,0,0,1), which means that the sum of chromaticity and luminance of the target pixel with sub-pixel values (r,g,b,w) compared with the corresponding target pixel with sub-pixel values (R,G,B) shall be boosted up to a factor of 2, so as to make the backlight luminance of the RGBW display device consistent with the backlight luminance of the RGB display device for the target pixel.

Therefore, the transmittance effect calculation unit 140 calculates the transmittance effect parameter corresponding to the target pixel of the target block B_J according to functions (2) and (3) as follows.

$$\begin{cases} R' = f_R(r, w) \\ G' = f_G(g, w) \\ B' = f_B(b, w) \end{cases} \tag{2}$$

$$\text{B_Gain} = f_{BG}(R', G', B', R, G, B) \tag{3}$$

wherein $f_R$, $f_G$ and $f_B$ denote functions for converting sub-pixel values r', g', b' and w' into converted sub-pixel values R', G' and B' of the target pixel, respectively; and B_Gain is the transmittance effect parameter of the target pixel and can be obtained by a function $f_{BG}$ of sub-pixel values R', G' B, R, G, and B. The function $f_{BG}$ can have any mathematical forms as required by different designs and panel types.

The transmittance effect parameter B_Gain results from the transmittances of the red, blue and green sub-pixel values different from the white sub-pixel value of the target pixel. For example, the transmittance effect parameter B_Gain is 1 for the target pixel with sub-pixel values rgbw(1,1,1,1); and the transmittance effect parameter B_Gain for example can be a constant such as 2 for the target pixel with sub-pixel values rgbw(1,0,0,0). In summary, the transmittance effect parameter B_Gain can be used to compensate the differences between transmittances of pixels of different colors.

The HK effect calculation unit 141 is coupled to the pixel-based boosting unit 142, and configured to calculate a human eye sensing capability parameter such as but not limit to the HK effect parameter according to the sub-pixel values RGB of the target pixel. The HK effect is the phenomenon in which two color stimuli have the same luminance but different chromaticity for a certain hue, so the perceived brightness induced by the two stimuli are different. Researches show that the color with small HK effect such as yellow and cyan will have more terrible perceived performance compared to other colors. Thus, there is a need to boost the backlight of the color by involving the HK effect to improve perceived performance of yellow and cyan. In short, the human eye sensing capability parameter such as but not limit to the HK effect parameter HK_effect results from different sensing capability of human eyes for different colors. In one embodiment, the human eye sensing capability parameter such as but not limit to the HK effect parameter is an outcome of a lookup table or a function by inputting the sub-pixel values (R,G,B) of the target pixel, and the lookup and the function are established based on researches regarding the HK effect for compensating the perceived difference between difference colors represented by different sub-pixel values.

In one embodiment, the pixel-based boosting unit 142 is configured to calculate the HK effect parameter according to a chromatic luminance of the target pixel corresponding to a hue, and sub-pixel values of the target pixel, which can be represented by a function (4) as follows.

$$\text{HK_effect} = f_{HK}(\text{HK}, R, G, B) \tag{4}$$

wherein HK_effect is the HK effect parameter and may be realized by any possible human eye sensing capability parameter, HK is the chromatic luminance of the target pixel corresponding to the hue, and R, G, and B are the sub-pixel values of the target pixel.

In this embodiment, HK_effect is a function $f_{HK}$ of HK, R, G, and B. The HK effect parameter HK_effect results from different sensing capability of human eyes for different colors. In some other embodiments, the HK effect parameter HK_effect of the target pixel can be obtained by considering more parameters including at least one of a saturation, a maximum among the sub-pixel values (R,G,B), and a maximum chromatic luminance max HK corresponding to the hue. The function $f_{HK}$ can have any mathematical forms as required by different designs and panel types. In more embodiments, any possible human eye sensing capability parameter may take place of the HK effect parameter or take the HK effect parameter into account.

In some embodiments, the pixel-based boosting unit 142 is configured to calculate a pixel-based boosting ratio corresponding to the target pixel according to the human eye sensing capability parameter such as but not limit to the HK effect parameter corresponding to the target pixel. The pixel-based boosting unit 142 is configured to calculate a pixel-based boosting ratio corresponding to the target pixel according to not only the HK effect parameter corresponding to the target pixel but also the transmittance effect parameter B_Gain. In other words, the pixel-based boosting unit 142 calculates the pixel-based boosting ratio according to function (4.1) as follows.

$$\text{Per_target}=f_B(B_\text{Gain},\text{HK_effect}) \tag{4.1}$$

wherein Per_target is the pixel-based boosting ratio corresponding to the target pixel, and HK_effect is the HK effect parameter corresponding to the target pixel. The human eye sensing capability parameter such as but not limit to the HK effect parameter HK_effect results from different sensing capability of human eyes for different colors, and $f_B$ is a function representing the pixel-based boosting ratio Per_target as a function of B_Gain and HK_effect. The function $f_B$ can have any mathematical forms as required by different designs and panel types.

According to function (4.1), the pixel-based boosting ratio Per_target is obtained according to the human eye sensing capability parameter such as but not limit to the HK effect parameter HK_effect and the transmittance effect parameter B_Gain.

In some embodiments, the pixel-based boosting unit 142 calculates the pixel-based boosting ratio according to function (4.2), (4.3) and (4.4) as follows.

$$\text{Delta_}Y=|2*Y11-Y22| \tag{4.2}$$

$$Y11=L_{RGB}+\text{HK_effect} \tag{4.3}$$

$$Y22=L_{rgbw}+\text{HK_effect} \tag{4.4}$$

wherein Delta_Y is the pixel-based boosting ratio corresponding to the target pixel, Y11 is a function of the HK effect parameter HK_effect and the luminance $L_{RGB}$ of the sub-pixel values (R,G,B) corresponding to the target pixel, Y22 is a function of the HK effect parameter HK_effect and the luminance $L_{rgbw}$ of the sub-pixel values (r,g,b,w) corresponding to the target pixel. The pixel-based boosting ratio Delta_Y is a function of the functions Y11 and Y22. In one embodiment, Y11 is a sum of the HK effect parameter HK_effect and the luminance $L_{RGB}$ of the sub-pixel values (R,G,B) corresponding to the target pixel, and Y22 is a sum of the HK effect parameter HK_effect and the luminance $L_{rgbw}$ Of the sub-pixel values (r,g,b,w) corresponding to the target pixel. Given that the maximum luminance of the RGBW panel is double of the maximum luminance of the RGB panel, the pixel-based boosting ratio Delta_Y describes a luminance difference that the sub-pixel values (R,G,B) should be boosted to make the output sub-pixel values having the luminance consistent with the luminance of the RGBW panel.

In the boosting unit 14, the backlight of the RGBW display device is boosted by the transmittance effect parameter B_Gain, the pixel-based boosting ratio Per_target or the pixel-based boosting ratio Delta_Y to be consistent with the backlight of the RGB display. Further, when taking the HK effect parameter HK_effect due to perceived capability of human eyes into consideration of backlight adjustment, the backlight duty for the color with the higher chromatic luminance HK (such as red, pink, magenta, and blue) shall be adjusted by a smaller K effect parameter HK_effect, and the backlight duty for the color with the smaller chromatic luminance HK (such as yellow and cyan) shall be adjusted by a greater HK effect parameter HK_effect. Therefore, the perceived performance for every color displayed by the RGBW display panel can be visually balanced.

Figure 1C:
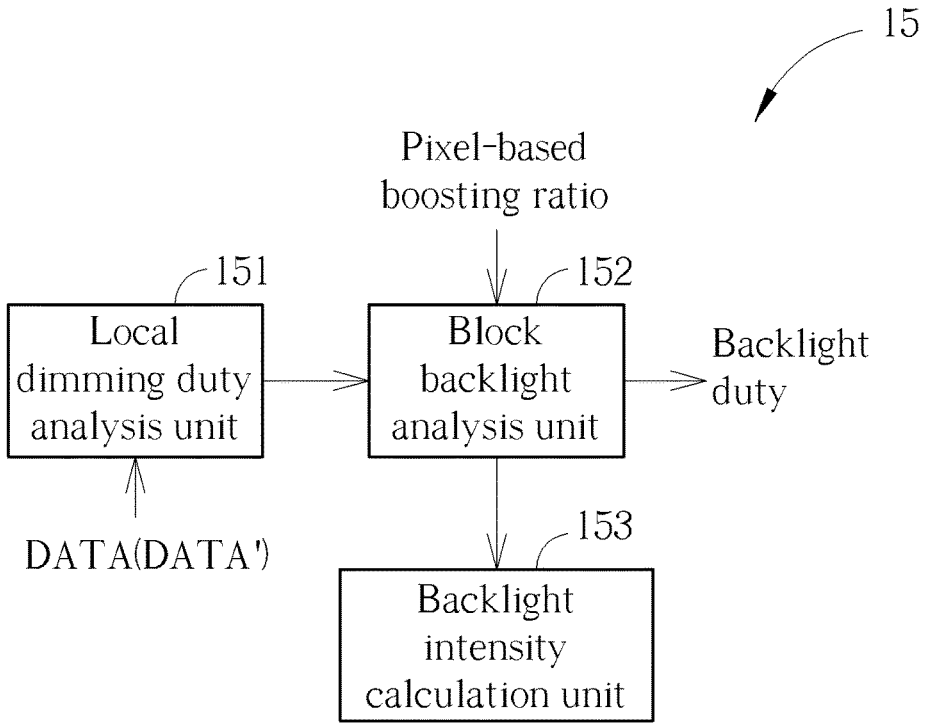
FIG. 1C is a functional block diagram of the backlight control unit in FIG. 1 according to an embodiment of the present invention.

FIG. 1C is a functional block diagram of the backlight control unit 15 in FIG. 1 according to an embodiment of the present invention. In one embodiment, the backlight control unit 15 may not be integrated with the display control circuit 1. The backlight control unit 15 includes a local dimming duty analysis unit 151, a block backlight analysis unit 152, and a backlight intensity calculation unit 153.

The local dimming duty analysis unit 151 is coupled to the block backlight analysis unit 152, and configured to calculate a plurality of segmental local dimming duties of corresponding to an image frame (e.g., DATA or DATA'). Specifically, the image frame is divided into non-overlapping blocks B_1-B_K, wherein a segment of the image frame is associated with one or a group of the blocks B_1-B_K, and K is an integer. For example, a segmental local dimming duty is used to control one or a group of backlight source(s) such as light emitting diode(s).

The local dimming duty analysis unit 151 calculates a segmental local dimming duty corresponding to a J-th segment. For example:

$$D_J=\max(r_m,g_m,b_m,w_m),m\in B_J \tag{1}$$

wherein D_J is the J-th segmental local dimming duty corresponding to a target block B_J, each of the blocks B_1-B_K includes a plurality of pixels, and r_m, g_m, b_m, w_m are red, green, blue and white sub-pixel values of an m-th pixel of the target block B_J. According to function (1), the segmental local dimming duty equals a maximum of red, green, blue and white sub-pixel values among m pixels of the target block B_J.

The backlight intensity calculation unit 153 is to give an estimation result of backlight intensity based on the backlight duty cycles and light profile of the segment associated with the target block B_J or a group of blocks including the target block B_J. The backlight intensity calculation unit 153 is coupled to the block backlight analysis unit 152, and configured to calculate the backlight intensity in blocks by making convolution between segmental local dimming duties and light spread profile of the group of blocks associated with the segment. The light spread profile stores the coefficient associated with the light intensity influence on each block by associated LEDs.

The block backlight analysis unit 152 is coupled to the local dimming duty analysis unit 151 and the backlight intensity calculation unit 153, and configured to calculate a block-based boosting ratio corresponding to the target block B_J comprising the target pixel according to a plurality of pixel-based boosting ratios Per_target_m of the plurality of pixels of the target block B_J. In other words, the block backlight analysis 15 calculates the block-based boosting ratio according to function (5) as follows.

$$\text{Block_target_}J=f_{BT}(\text{Per_target_}m),m\in B_J \quad (5)$$

wherein Block_target_J is the block-based boosting ratio corresponding to the target block B_J, and m is an index number of pixels of the pixels of the target block B_J. According to function (5), the block-based boosting ratio corresponding to the target block B_J can be obtained by a function $f_{BT}$ of the plurality of pixel-based boosting ratios Per_target corresponding to the plurality of pixels of the target block B_J. The function $f_{HK}$ can have any mathematical forms as required by different designs and panel types. For example, the function $f_{BT}$ can be a maximum equation.

For the target block B_J including multiple pixels, the block backlight analysis unit 152 is further configured to calculate a respective final duty cycle corresponding to the target block B_J (or, a segment associated with a group of blocks including the target block B_J). The block backlight analysis 152 calculates the final backlight duty according to function (6) as follows.

$$BL_J=D_J*\text{Block_target_}J \quad (6)$$

wherein BL_J is the respective final duty cycle. According to function (6), the respective final duty cycle BL_J equals the block-based boosting ratio Block_target_J multiplying with the J-th segmental local dimming duty D_J corresponding to the target block B_J. The purpose of local dimming may be to save power consumption and keep the luminance of the RGBW display device consistent with the original luminance of the RGB display device; in one embodiment, the respective final duty cycle can be obtained according to any schemes and calculations of the prior art.

Figure 2:
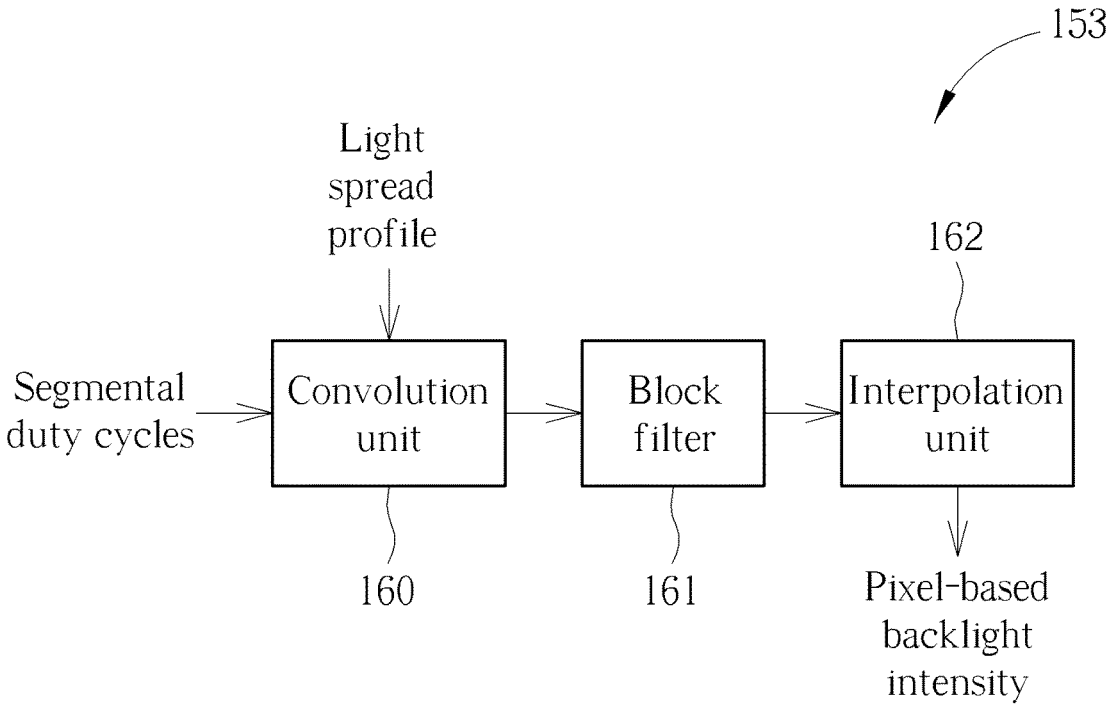
FIG. 2 is a functional block diagram of the backlight intensity calculation unit of FIG. 1 according to an embodiment of the present invention.

FIG. 2 is a functional block diagram of the backlight intensity calculation unit 153 according to an embodiment of the present invention. The backlight intensity calculation unit 153 includes a convolution unit 160, a block filter 161 and an interpolation unit 162.

The backlight intensity calculation unit 153 behaves as a transition from the segmental local dimming duty with low resolution to a block-based backlight intensity with a little bit high resolution, and then calculates a pixel-based backlight intensity according to the block-based backlight intensity, in order to compensate the target pixel based on the pixel-based backlight intensity. The pixel-based backlight intensity is calculated based on contributions of one or a group of backlight sources associated with the segment of the image frame where the target pixel is located.

The convolution unit 160 is coupled to the block filter 161, and configured to calculate the block-based backlight intensity by making convolution between a plurality of segmental local dimming duties and light spread profile corresponding to the segmental local dimming duties.

Figure 3:
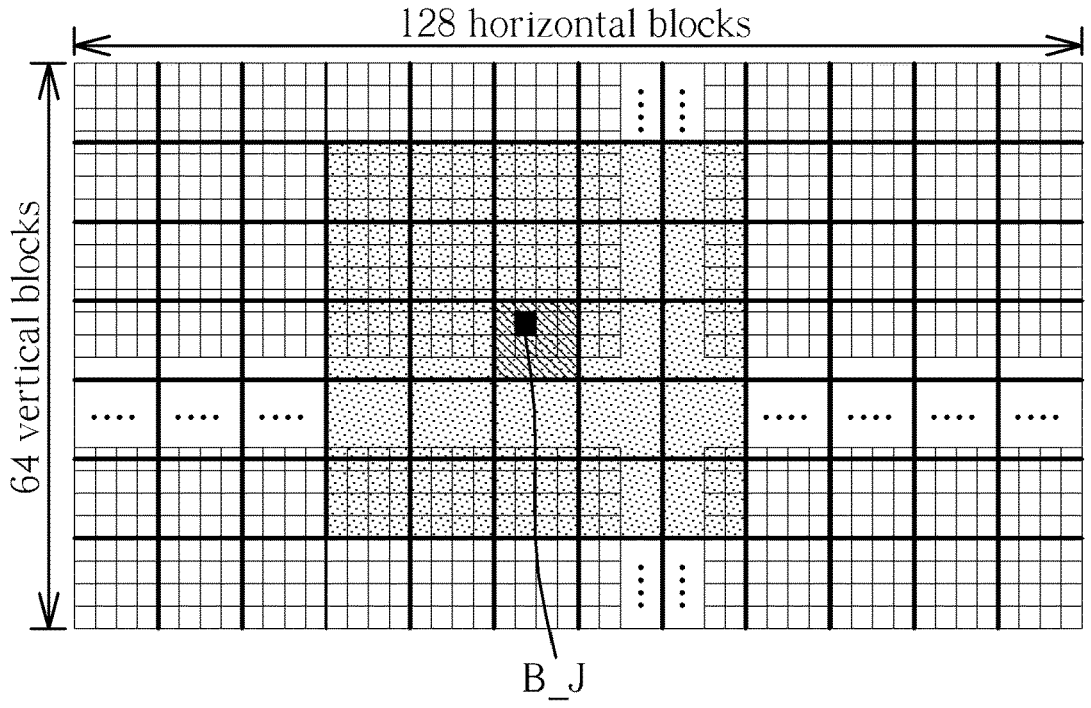
FIG. 3 is a schematic diagram of an image frame dividing into a plurality of blocks according to an embodiment of the present invention.

FIG. 3 is a schematic diagram of an image frame divided into a plurality of blocks according to an embodiment of the present invention. Given that the block resolution is 128×64, i.e., there are 128 horizontal blocks and 64 vertical blocks in the image frame of FIG. 3. And note that there is no relation between the numbers of segments and blocks.

Given a convolution mask with a size of 5*5 including 25 segments denoted with dot patterns and controlled by a same respective backlight duty cycle, and each of the segments corresponds to one backlight source such as an LED (Light Emission Diode), which means that there are 25 backlight sources controlled by the same respective backlight duty cycle.

For calculating the block-based backlight intensity of the target block B_J denoted with slash patterns in FIG. 3, light emissions of the 25 backlight sources within the convolution mask shall be considered for their influence on the target block B_J. The light spread profile stores the coefficient describing the influence of each segment within the convolution mask. The convolution unit 160 calculates the block-based backlight intensity of the target block B_J according to function (7) as follows.

$$\text{Block_Intensity_}J=\text{SUM}(\text{Duty_1*coef_1+Duty_2*coef_2+}\ldots\text{+Duty_}N\text{*coef_}N)/\text{PROFILE_SUM} \quad (7)$$

wherein Block_Intensity_J is the block-based backlight intensity of the target block B_J, N is the size of the convolutional mask (i.e., N=5*5=25), Duty N is a N-th segmental duty of the convolutional mask, coef_1-coef_N are coefficients describing the influence corresponding to the first to N-th segments, and Profile_SUM is a sum of the coefficients coef_1-coef_N.

In one embodiment, the convolution unit 160 calculates the block-based backlight intensity of the target block B_J according to function (7.1) as follows.

$$\text{Block_Intensity_}J=\text{Duty_Sum*Gain>>Bits} \quad (7.1)$$

wherein Duty_Sum is a sum of a plurality of segmental duties associated with the target block B_J, and Gain and Bits are coefficients describing the influence corresponding to the target block B_J and can be set by registers.

Figure 4:
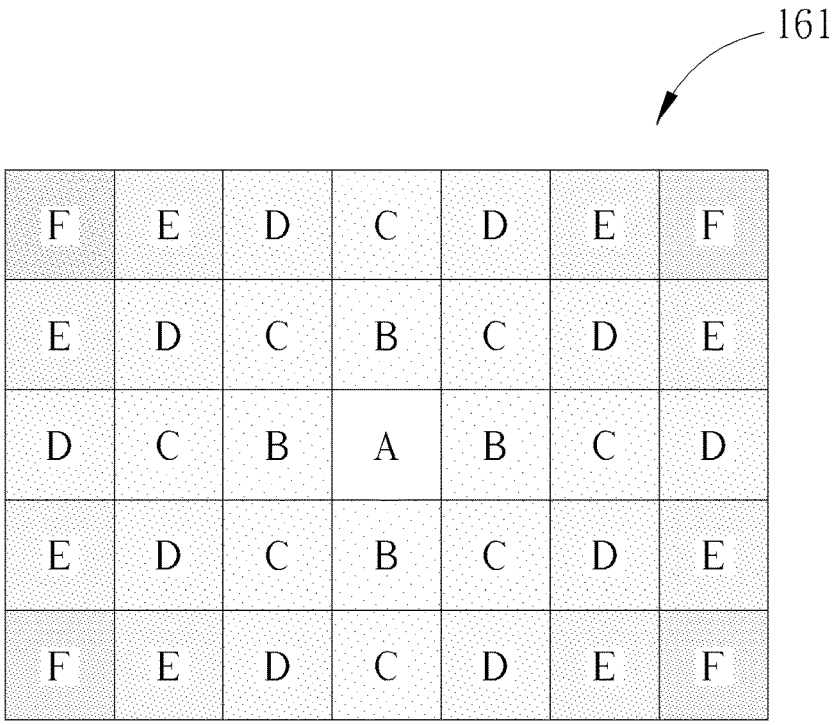
FIG. 4 is a schematic diagram of the block filter of FIG. 2 according to an embodiment of the present invention.

FIG. 4 is a schematic diagram of the block filter 161 according to an embodiment of the present invention. The block filter 161 is coupled to the convolution unit 160 and the interpolation unit 162, and configured to smooth the block-based backlight intensity after the convolution. Given that the block filter 161 is a low-pass filter including a plurality of block filter units (e.g., 5 (rows)*7 (columns)=35 block filter units), and each of the block filter units corresponds to a weighting.

The block filter 161 multiplies a plurality of block-based backlight intensities corresponding to a segment with the weightings corresponding to the block filter units. Table 1 illustrates the weightings corresponding to the block filter units; in one embodiment, the weightings can be set by registers or a lookup table.

| Name of Block filter unit | Weighting |
|---|---|
| A | 0.56 |
| B | 0.37 |
| C | 0.20 |
| D | 0.10 |
| E | 0.05 |
| F | 0.02 |

Figure 5:
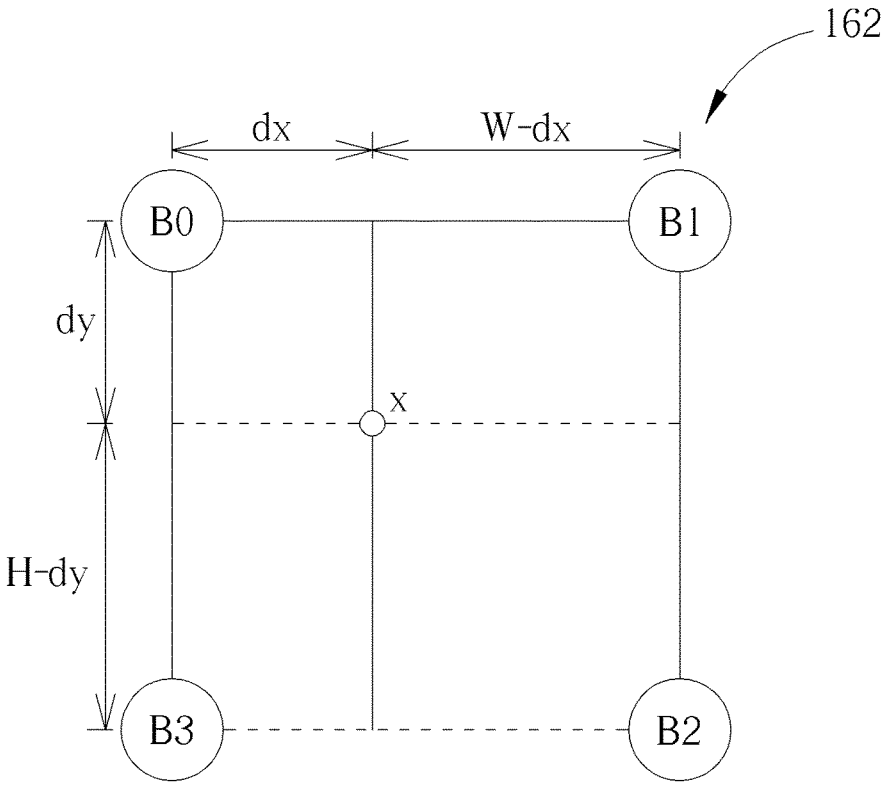
FIG. 5 is a schematic diagram of the interpolation unit of FIG. 2 according to an embodiment of the present invention.

FIG. 5 is a schematic diagram of the interpolation unit 162 according to an embodiment of the present invention. The interpolation unit 162 is coupled to the block filter 161 and the compensation unit 17, and configured to calculate a pixel-based backlight intensity of a target pixel x by performing pixel interpolation to a plurality of block-based backlight intensities around the target pixel x, wherein the pixel interpolation is a bilinear interpolation.

Given that B0, B1, B2, and B3 are block-based backlight intensities around the target pixel x of the target block B_J. The interpolation unit 162 calculates the pixel-based intensity of the target pixel x according to function (8) as follows.

$$\text{Pixel_intensity}=((B0*(W-dx)+B1*dx)*(H-dy)+(B3*(W-dx)+B2*dx)*dy)/(W*H) \quad (8)$$

wherein Pixel_intensity is the pixel-based intensity of the target pixel x, W and H are width and height of the target block B_J, and dx, (W−dx), dy and (H−dy) are horizontal and vertical distances between the target pixel x to the neighboring blocks.

In one embodiment, the interpolation unit 162 calculates the pixel-based intensity of the target pixel x according to function (8.1) as follows.

$$\text{Pixel_intensity}=\text{Block_Sum}*\text{Mul_reg}>>\text{SHIFT_reg} \quad (8.1)$$

wherein Block_Sum is a sum of block-based backlight intensities around the target pixel x of the target block B_J, values of the numerators Mul_reg and SHIFT_reg can be set by registers. Since there are four possible block size (with and without remainder for horizontal and vertical direction when the image frame is divided into 128×64 blocks), there will be four sets of values of the numerators Mul_reg and SHIFT_reg.

Referring to FIG. 1A, the compensation unit 17 is coupled to the first de-gamma unit 11, and the gamma unit 18, and configured to calculate a final pixel-based gain of the target pixel according to the pixel-based boosting ratio Per_target and the pixel-based intensity Pixel_intensity. The compensation unit 17 calculates the final pixel-based gain according to function (9) as follows.

$$\text{Gain}=f_{Gain}(\text{Per_target},\text{Pixel_intensity}) \quad (9)$$

wherein Gain is the final pixel-based gain of the target pixel. According to function (9), the final pixel-based gain of the target pixel can be obtained according to the pixel-based boosting ratio Per_target and the pixel-based intensity Pixel_intensity by using the function $f_{Gain}$, which can have any mathematical forms as required by different designs and panel types.

The compensation unit 17 is further configured to compensate the sub-pixel values (r,g,b,w) of the target pixel to generate compensated sub-pixel values of the target pixel according to function (10) as follows.

$$\begin{cases} Rout = r*\text{Gain} \\ Gout = g*\text{Gain} \\ Bout = b*\text{Gain} \\ Wout = w*\text{Gain} \end{cases} \quad (10)$$

wherein Rout, Gout, Bout and Wout are compensated sub-pixel values of the target pixel. According to function (10), the compensated sub-pixel values (Rout, Gout, Bout, Wout) of the target pixel are multiplications of the sub-pixel values (r, g, b, w) and the final pixel-based gain Gain.

Briefly speaking, the display control circuit 1 of the present invention receives the sub-pixel values (R,G,B) of the target pixel among m pixels of one image frame, calculates the pixel-based boosting ratio (i.e., Per_target) corresponding to the target pixel according to the sub-pixel values (R,G,B) of the target pixel by involving the HK effect parameter (i.e., HK_effect) corresponding to the sub-pixel values of the target pixel, and adjusts at least one of the of the backlight duty of the target block (i.e., BL_J) and the sub-pixel values of the target pixel (i.e., (r,g,b,w)) according to the pixel-based boosting ratio. Therefore, the display control circuit 1 of the present invention can improve the perceived performance of the RGBW display device when showing color with small HK effect parameter such as yellow and cyan.

Figure 1D:
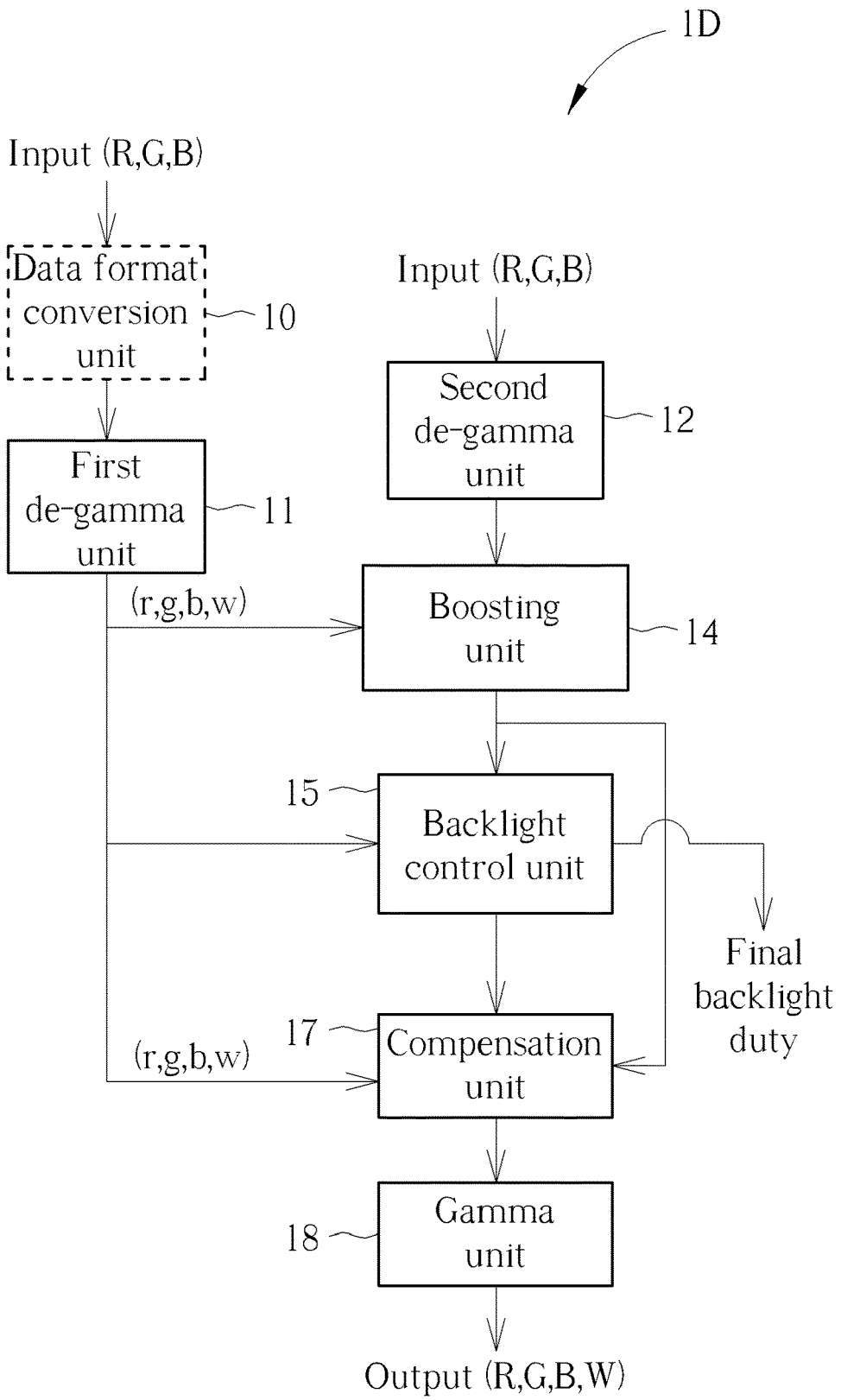
FIG. 1D is a functional block diagram of a display control circuit according to an embodiment of the present invention.

FIG. 1D is a functional block diagram of a display control circuit 1D according to an embodiment of the present invention. The display control circuit 1D can be used for controlling a display device (e.g., RGBW panel or RGB panel) according to an image or a video with RGB format. The display control circuit 1D includes the data format conversion unit 10, a first de-gamma unit 11, a second de-gamma unit 12, the boosting unit 14, the backlight control unit 15, the compensation unit 17, and a gamma unit 18.

The data format conversion unit 10 is coupled to the first de-gamma unit 11, and configured to convert an image frame DATA with a first format (e.g., RGB format) into a converted image frame DATA' with a second format (e.g., RGBW format). For example, the RGB-to-RGBW conversion unit 10 performs the RGB-to-RGBW conversion process to convert a pixel with sub-pixel values (R,G,B) into a pixel with sub-pixel values (r,g,b,w). The data format conversion unit 10 may be excluded from the display control circuit 1D if it is used for an RGB panel.

The first de-gamma unit 11 is coupled to the RGB-to-RGBW conversion unit 10, the boosting unit 14, the backlight control unit 15 and the compensation unit 17, and configured to perform a de-gamma process to the pixel with sub-pixel values (r,g,b,w). The second de-gamma unit 12 is coupled to the boosting unit 14, and configured to perform a de-gamma process to the pixel with sub-pixel values (R,G,B).

The gamma unit 18 is coupled to the compensation unit 17, and configured to perform a gamma process to compensated sub-pixel values of the target pixel to generate output sub-pixel values of the target pixel.

Figure 6:
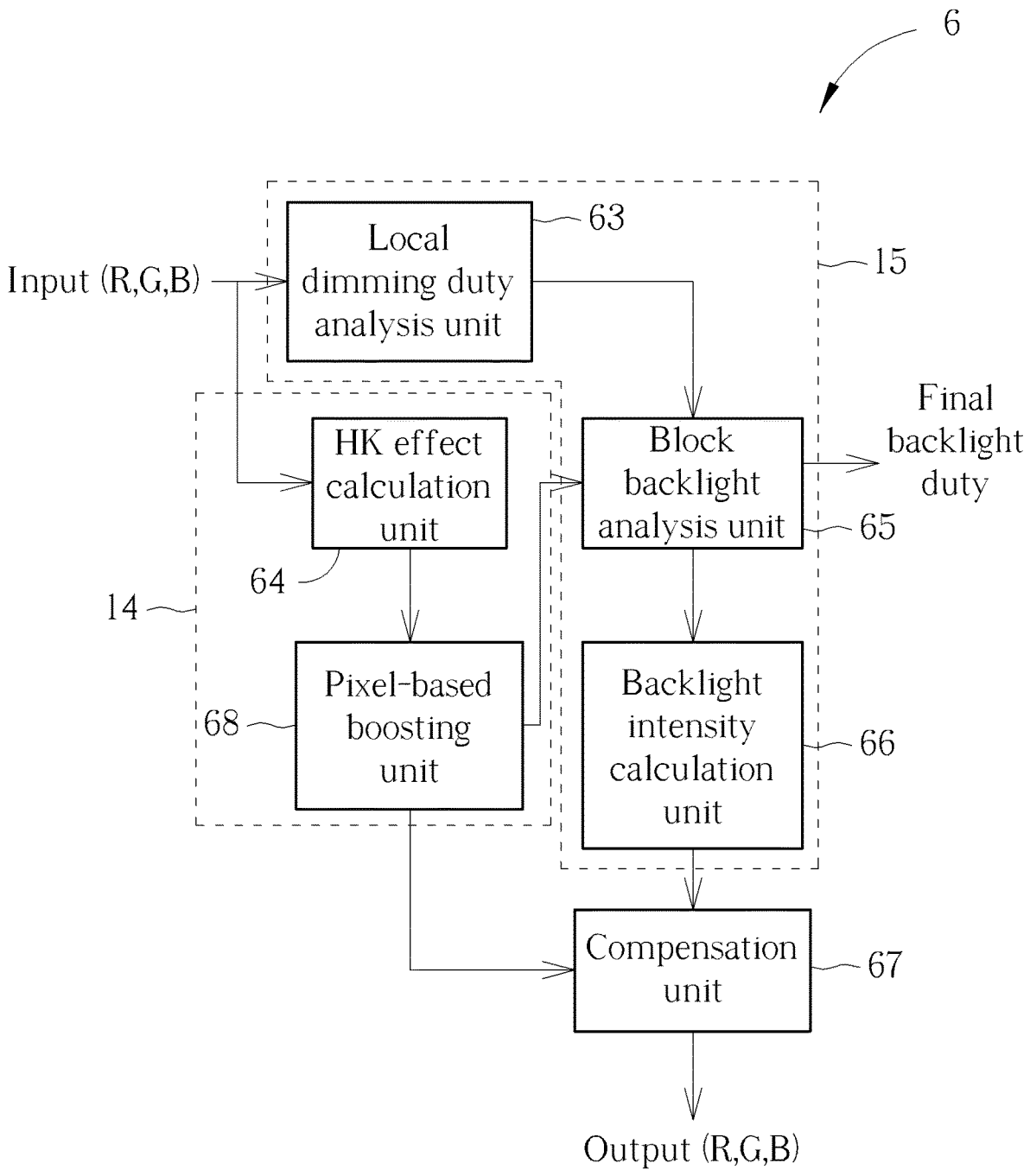
FIG. 6 is a functional block diagram of a display control circuit according to an embodiment of the present invention.

FIG. 6 is a functional block diagram of a display control circuit 6 according to an embodiment of the present invention. The display control circuit 6 is used for controlling an RGB display device according to an image or a video with RGB format. The display control circuit 6 includes a local dimming duty analysis unit 63, an HK effect calculation unit 64, a block backlight analysis unit 65, a backlight intensity calculation unit 66, a compensation unit 67, and a pixel-based boosting unit 68. In one embodiment, the HK effect calculation unit 64 and the pixel-based boosting unit 68 operate as the boosting unit 14 in FIG. 1A or FIG. 1D; the local dimming duty analysis unit 63, the block backlight analysis unit 65 and the backlight intensity calculation unit 66 operate as the backlight control unit 15 in FIG. 1A or FIG. 1D.

The local dimming duty analysis unit 63 is coupled to the block backlight analysis unit 65, and configured to calculate a plurality of segmental local dimming duties of corresponding to the image frame. Specifically, the image frame is divided into non-overlapping blocks B_1-B_K, wherein a segment of the image frame is associated with one or a group of the blocks B_1-B_K, and K is an integer. For example, a segmental local dimming duty is used to control one or a group of backlight source(s).

The local dimming duty analysis unit 63 calculates a segmental local dimming duty corresponding to a J-th segment according to function (11) as follows.

$$D_J=\max(R_m,G_m,B_m),m\in B_J \quad (11)$$

wherein D_J is the segmental local dimming duty, B_J is a target block of a target pixel, m is a number of pixels of the target block, and R_m, G_m and B_m are sub-pixel values of the target pixel. According to function (11), the segmental local dimming duty D_J is a maximum of sub-pixel values among all the pixels of the target block B_J.

The HK effect calculation unit 64 is coupled to the block backlight analysis unit 65 and the pixel-based boosting unit 68, and configured to calculate an HK effect parameter according to functions (12.1) and (12.2) as follows.

$$\text{HK_effect}=f_H K(\text{HK}) \quad (12.1)$$

$$\text{HK_effect}=1+(\max \text{HK}-\text{HK})*\max(R,G,B) \quad (12.2)$$

wherein HK_effect is such as but not limit to the HK effect parameter, HK is a chromatic luminance of the target pixel corresponding to a hue, and $f_{HK}$ denotes is for converting the chromatic luminance HK to the HK effect parameter HK_effect and can have any mathematical forms as required by different designs and panel types. In one embodiment, HK effect parameter HK_effect can be obtained from function (12.1), in which the HK effect parameter HK_effect of the target pixel equals 1 and the maximum among the sub-pixel values (R,G,B) multiplied with a difference between the maximum chromatic luminance and the chromatic luminance.

The block backlight analysis unit 65 is coupled to the local dimming duty analysis unit 63, the HK effect calculation unit 64 and the backlight intensity calculation unit 66, and configured to calculate a block-based boosting ratio corresponding to the target block B_J comprising the target pixel according to a plurality of pixel-based boosting ratios Per_target_m of the plurality of pixels of the target block B_J. The block backlight analysis 65 calculates the block-based boosting ratio according to function (5).

The pixel-based boosting unit 68 is coupled to the HK effect calculation unit 64 and the compensation unit 67, and configured to calculate a pixel-based boosting ratio according to function (13) as follows.

$$\text{Per_target}=f_{bootsing}(R,G,B)*\text{HK_effect} \quad (13)$$

wherein Per_target is the pixel-based boosting ratio and $f_{bootsing}$ is a function of R, G and B which may have any mathematical forms satisfying design requirements. According to function (13), the pixel-based boosting ratio Per_target of the target pixel is a multiplication of the sub-pixel values (R,G,B) and the HK effect parameter HK_effect.

The compensation unit 67 is coupled to the backlight intensity calculation unit 66 and the pixel-based boosting unit 68, and configured to calculate a final pixel-based gain of the target pixel according to the pixel-based boosting ratio Per_target and the pixel-based intensity Pixel_intensity. The compensation unit 67 calculates the final pixel-based gain according to function (9).

The compensation unit 67 is further configured to compensate the sub-pixel values (R,G,B) of the target pixel to generate compensated sub-pixel values of the target pixel according to function (14) as follows.

$$\begin{cases} Rout = R*\text{Gain} \\ Gout = G*\text{Gain} \\ Bout = B*\text{Gain} \end{cases} \quad (14)$$

wherein Rout, Gout, and Bout are compensated sub-pixel values of the target pixel. According to function (14), the compensated sub-pixel values (Rout, Gout, Bout) of the target pixel are multiplications of the sub-pixel values (R,G,B) and the final pixel-based gain Gain.

In one embodiment, the display control circuit 6 further includes the second de-gamma unit 12 and the gamma unit 18 as shown in FIG. 1, which are not shown in FIG. 6. The second de-gamma unit 12 is coupled to the local dimming duty analysis unit 63 and the HK effect calculation unit 64, and configured to perform a de-gamma process to the input sub-pixel values (R,G,B) before they are inputted to the local dimming duty analysis unit 63 and the HK effect calculation unit 64. The gamma unit 18 is coupled to the compensation unit 67, and configured to perform a gamma process to the output sub-pixel values (R,G,B).

Briefly speaking, the display control circuit 6 of the present embodiment receives the sub-pixel values (R,G,B) of the target pixel among m pixels of one image frame, calculates the pixel-based boosting ratio (i.e., Per_target) corresponding to the target pixel according to the sub-pixel values (R,G,B) of the target pixel by involving the human eye sensing capability parameter such as but not limit to the HK effect parameter (i.e., HK_effect) corresponding to the sub-pixel values of the target pixel, and adjusts at least one of the of the backlight duty of the target block (i.e., BL_J) and the sub-pixel values of the target pixel (i.e., (R,G,B)) according to the pixel-based boosting ratio. Therefore, the display control circuit 6 of the present invention can improve the perceived performance of the RGB display device when showing color with small HK effect parameter such as yellow and cyan.

Figure 7:
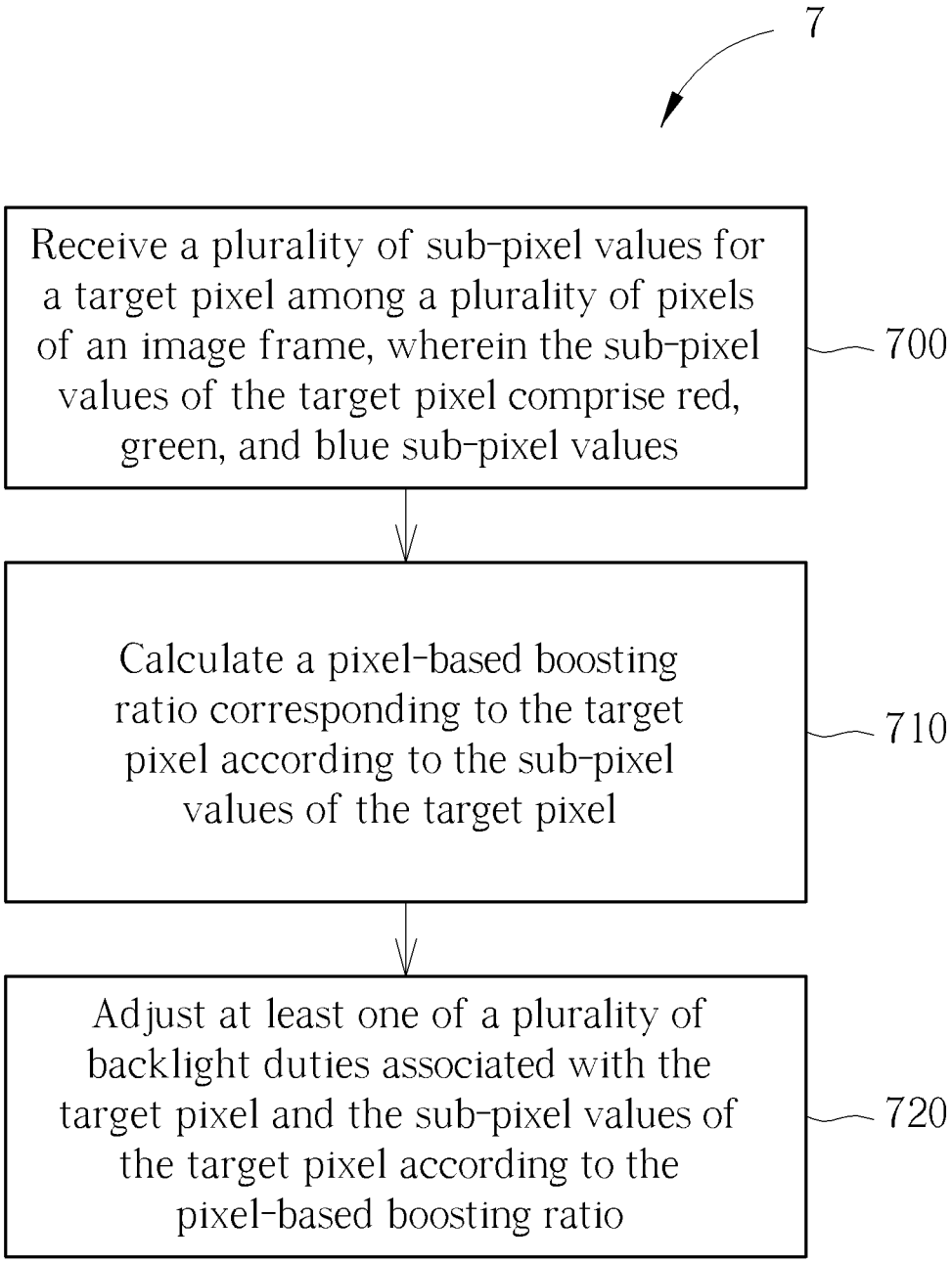
FIG. 7 is a flowchart of a process of controlling a display device according to an embodiment of the present invention.

Operations of the display control circuits 1, 1D and 6 can be summarized into a process 7 of controlling a display device, as shown in FIG. 7, and the process 7 includes the following steps.

Step 700: Receive a plurality of sub-pixel values for a target pixel among a plurality of pixels of an image frame, wherein the sub-pixel values of the target pixel comprise red, green, and blue sub-pixel values.

Step 710: Calculate a pixel-based boosting ratio corresponding to the target pixel according to the sub-pixel values of the target pixel.

Step 720: Adjust at least one of a plurality of backlight duties associated with the target pixel and the sub-pixel values of the target pixel according to the pixel-based boosting ratio.

In the process 7, Step 700 is performed by the RGB-to-RGBW conversion unit 10, the first de-gamma unit 11 and the second de-gamma unit 12 of the display control circuit 1. Step 710 is performed by the boosting unit 14 of the display control circuit 1. Step 720 is performed by the local dimming duty analysis unit 13, the backlight control unit 15, and the compensation unit 17 of the display control circuit 1.

On the other hand, Step 700 and Step 710 are performed by the HK effect calculation unit 64 and the pixel-based boosting unit 68 of the display control circuit 6. Step 700 and Step 720 are performed by the local dimming duty analysis unit 63, the block backlight analysis unit 65, the backlight intensity calculation unit 66 and the compensation unit 67 of the display control circuit 6.

Figure 8:
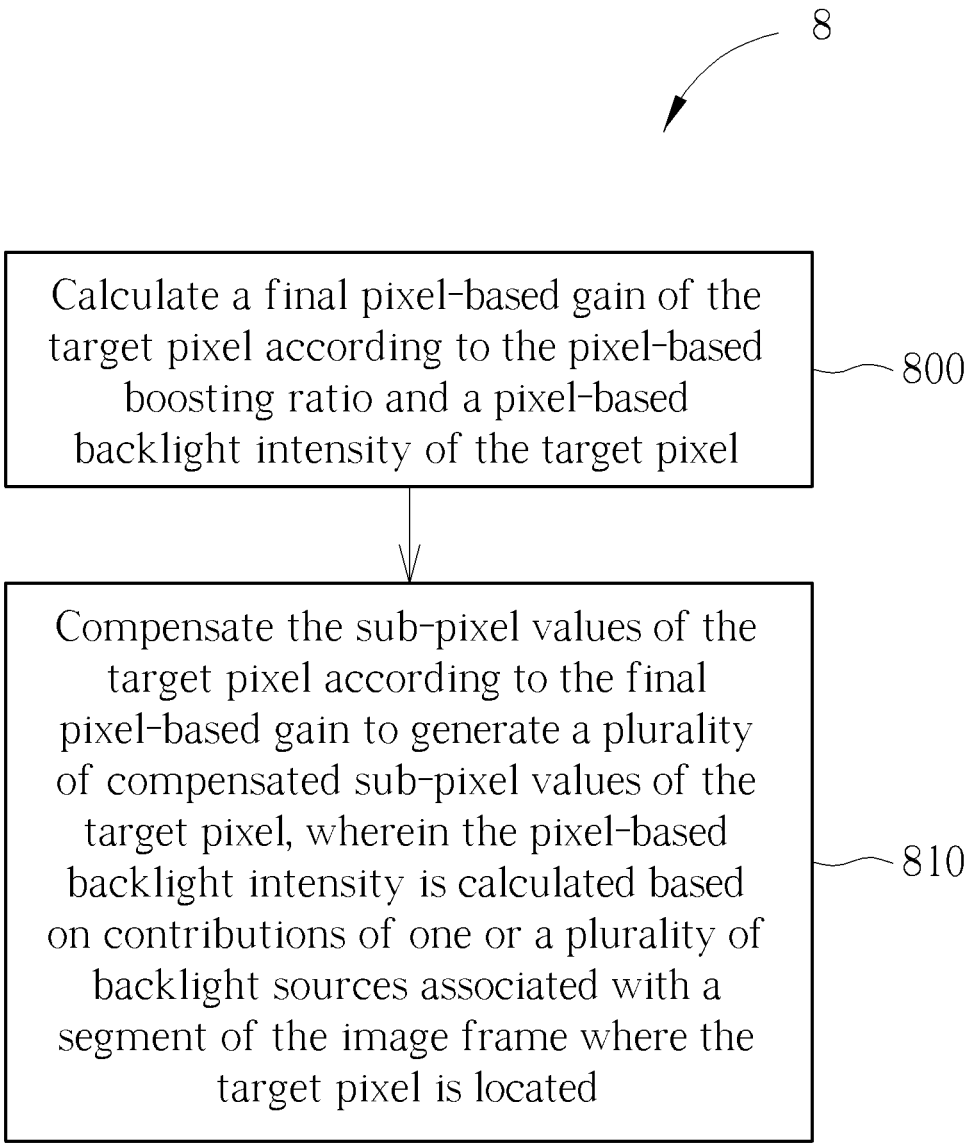
FIG. 8 is a flowchart of a process of image data compensation according to an embodiment of the present invention.

Operations (i.e., Step 720) of the local dimming duty analysis unit 63, the block backlight analysis unit 65, the backlight intensity calculation unit 66 and the compensation unit 67 may be further summarized into a process 8 of image data compensation, as shown in FIG. 8, and the process 8 includes the following steps.

Step 800: Calculate a final pixel-based gain of the target pixel according to the pixel-based boosting ratio and a pixel-based backlight intensity of the target pixel.

Step 810: Compensate the sub-pixel values of the target pixel according to the final pixel-based gain to generate a plurality of compensated sub-pixel values of the target pixel, wherein the pixel-based backlight intensity is calculated based on contributions of one or a plurality of backlight sources associated with a segment of the image frame where the target pixel is located.

In the process 8, Step 800 is performed by the backlight intensity calculation unit 66, wherein the backlight intensity calculation unit 66 calculates the final pixel-based gain of the target pixel according to the pixel-based boosting ratio calculated by the pixel-based boosting unit 68 and the pixel-based backlight intensity of the target pixel. Step 810 is performed by the compensation unit 67, wherein the compensation unit 67 compensates the sub-pixel values of the target pixel according to the pixel-based boosting ratio calculated by the pixel-based boosting unit 68 and the pixel-based backlight intensity generated by the backlight intensity calculation unit 66.

In practice, the process 7 may be compiled into a program code stored in a memory device for instructing a processing device to execute the steps of the process 7.

Detailed operations regarding the processes 7 and 8 may be obtained by referring to descriptions of FIG. 1 to FIG. 6.

To sum up, the display control circuit of the present invention receives the sub-pixel values (R,G,B) of the target pixel among a plurality of pixels of one image frame, calculates the pixel-based boosting ratio corresponding to the target pixel according to the sub-pixel values (R,G,B) of the target pixel by involving the HK effect parameter corresponding to the sub-pixel values (R,G,B) of the target pixel, and adjusts at least one of the of the backlight duty and the sub-pixel values of the target pixel according to the pixel-based boosting ratio. Therefore, the display control circuit of the present invention can improve the perceived performance of the display device. Above embodiments of the present invention take the HK effect parameter for examples without limitations, any kinds and forms of the human eye sensing capability parameter can be used to realize the embodiments of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of controlling a display device, comprising:

receiving a plurality of sub-pixel values for a target pixel among a plurality of pixels of an image frame, wherein the sub-pixel values of the target pixel comprise red, green, and blue sub-pixel values;

calculating a human eye sensing capability parameter corresponding to the target pixel according to the sub-pixel values of the target pixel so as to obtain a pixel-based boosting ratio corresponding to the target pixel according to the human eye sensing capability parameter;

calculating a block-based boosting ratio of a target block according to a plurality of pixel-based boosting ratios of a plurality of pixels, wherein the plurality of pixels of the target block comprises the target pixel;

adjusting a backlight duty associated with the target block and boosting an intensity of a backlight associated with the target block according to the block-based boosting ratio of the target block such that the backlight duty associated with the target block depends upon the human eye sensing capability parameter corresponding to the target pixel; and adjusting the plurality of sub-pixel values of the target pixel according to the pixel-based boosting ratio;

wherein the method further comprises:

performing a convolution operation between a plurality of segmental backlight duties and light spread profile corresponding to the plurality of segmental backlight duties to generate a block-based backlight intensity of a target block, wherein a convolution mask for the convolution operation comprises a plurality of segments of the image frame, and the target pixel locates in the target block of one of the plurality of segments; and calculating a pixel-based backlight intensity of the target pixel by performing pixel interpolation to a plurality of block-based backlight intensities of a plurality of blocks around the target block where the target pixel locates.

2. The method of claim 1, wherein calculating the pixel-based boosting ratio corresponding to the target pixel according to the sub-pixel values of the target pixel comprises:

providing a chromatic luminance of the target pixel corresponding to a hue;

calculating the chromatic luminance of the target pixel; and calculating the pixel-based boosting ratio corresponding to the target pixel according to the human eye sensing capability parameter corresponding to the target pixel.

3. The method of claim 2, wherein calculating the pixel-based boosting ratio corresponding to the target pixel according to the sub-pixel values of the target pixel comprises:

converting the target pixel from a first format into a second format by performing an RGB-to-RGBW conversion process, wherein the target pixel with the second format comprises red, green, blue and white sub-pixel values; and calculating the pixel-based boosting ratio corresponding to the target pixel according to the human eye sensing capability parameter, a first luminance of the target pixel with the first format and a second luminance of the target pixel with the second format;

wherein the pixel-based boosting ratio corresponding to the target pixel is calculated based on a first function of the human eye sensing capability parameter and the first luminance of the target pixel with the first format and a second function of the human eye sensing capability parameter and the second luminance of the target pixel with the second format.

4. The method of claim 1, wherein the human eye sensing capability parameter is a HK (Helmholtx-Kohklrausch)

effect parameter, and the HK effect parameter results from different sensing capability of human eyes for different colors.

5. The method of claim 4, wherein the HK effect parameter of the target pixel is obtained according to at least one of a saturation, a maximum among the sub-pixel values, and a maximum chromatic luminance of the target pixel corresponding to the hue.

6. The method of claim 4, wherein calculating the pixel-based boosting ratio corresponding to the target pixel according to the human eye sensing capability parameter corresponding to the target pixel comprises:

converting the sub-pixel values of the target pixel into converted sub-pixel values of the target pixel;

calculating a transmittance effect parameter corresponding to the target pixel according to the sub-pixel values and the converted sub-pixel values, wherein the transmittance effect parameter is used to compensate differences between transmittances of the target pixel and another pixel of different colors; and calculating the pixel-based boosting ratio corresponding to the target pixel based on the human eye sensing capability parameter of the target pixel and the transmittance effect parameter corresponding to the target pixel.

7. The method of claim 6, wherein converting the sub-pixel values of the target pixel into converted sub-pixel values of the target pixel comprises:

converting the red, green, blue sub-pixel values of the target pixel from a first format into a second format, wherein the target pixel with the second format comprises red, green, blue and white sub-pixel values, and the converted sub-pixel values comprises converted red, green, blue sub-pixel values;

calculating the converted red sub-pixel value based on the red and white sub-pixel values with the second format, the converted green sub-pixel value based on the green and white sub-pixel values with the second format, and the converted blue sub-pixel value based on the blue and white sub-pixel values with the second format.

8. The method of claim 1, wherein calculating the pixel-based boosting ratio corresponding to the target pixel according to the sub-pixel values of the target pixel comprises:

converting a chromatic luminance of the target pixel corresponding to a hue into the human eye sensing capability parameter of the target pixel; and calculating the pixel-based boosting ratio corresponding to the target pixel according to the human eye sensing capability parameter corresponding to the target pixel.

9. The method of claim 8, wherein the human eye sensing capability parameter is a HK (Helmholtx-Kohklrausch) effect parameter, and the HK effect parameter results from different sensing capability of human eyes for different colors.

10. The method of claim 8, wherein the human eye sensing capability parameter of the target pixel equals 1 and a maximum among the sub-pixel values multiplied with a difference between a maximum chromatic luminance and the chromatic luminance of the target pixel.

11. The method of claim 8, wherein the pixel-based boosting ratio of the target pixel is a multiplication of the sub-pixel values and the human eye sensing capability parameter of the target pixel.

12. The method of claim 1, wherein adjusting both the backlight duty associated with the target pixel according to the pixel-based boosting ratio comprises:

dividing the image frame into a plurality of non-overlapping blocks, wherein a segment of the image frame is associated with one or a group of the plurality of non-overlapping blocks;

wherein the plurality of non-overlapping blocks comprise the target block, and the plurality of pixels of the target block comprises the target pixel; and calculating a respective final duty cycle corresponding to the target block according to the block-based boosting ratio and a segmental local dimming duty corresponding to the target block.

13. The method of claim 12, wherein adjusting both the backlight duty associated with the target pixel according to the pixel-based boosting ratio further comprises:

calculating the segmental local dimming duty corresponding to the target block according to a maximum of sub-pixel values for the plurality of pixels of the target block.

14. The method of claim 1, wherein adjusting the sub-pixel values of the target pixel according to the pixel-based boosting ratio comprises:

calculating a final pixel-based gain of the target pixel according to the pixel-based boosting ratio and the pixel-based backlight intensity of the target pixel; and compensating the sub-pixel values of the target pixel according to the final pixel-based gain to generate a plurality of compensated sub-pixel values of the target pixel;

wherein the pixel-based backlight intensity is calculated based on contributions of one or a plurality of backlight sources associated with a segment of the image frame where the target pixel is located.

15. The method of claim 1, wherein adjusting the sub-pixel values of the target pixel according to the pixel-based boosting ratio comprises:

calculating a final pixel-based gain of the target pixel according to an output of the plurality of segmental backlight duties and the light spread profile of the plurality of segments of the image frame.

16. An electronic device for controlling a display device, comprising:

a processing device; and a memory device coupled to the processing device and configured to store a program code to instruct the processing device to perform a process for controlling the display device, wherein the process comprises:

receiving a plurality of sub-pixel values for a target pixel among a plurality of pixels of an image frame, wherein the sub-pixel values of the target pixel comprise red, green, and blue sub-pixel values;

calculating a human eye sensing capability parameter corresponding to the target pixel according to the sub-pixel values of the target pixel so as to obtain a pixel-based boosting ratio corresponding to the target pixel according to the human eye sensing capability parameter;

calculating a block-based boosting ratio of a target block according to a plurality of pixel-based boosting ratios of a plurality of pixels, wherein the plurality of pixels of the target block comprises the target pixel;

adjusting a backlight duty associated with the target block and boosting an intensity of a backlight associated with the target block according to the block-based boosting ratio of the target block such that the backlight duty associated with the target block depends upon the human eye sensing capability parameter corresponding to the target pixel; and adjusting the plurality of sub-pixel values of the target pixel according to the pixel-based boosting ratio;

wherein the process further comprises:

performing a convolution operation between a plurality of segmental backlight duties and light spread profile corresponding to the plurality of segmental backlight duties to generate a block-based backlight intensity of a target block, wherein a convolution mask for the convolution operation comprises a plurality of segments of the image frame, and the target pixel locates in the target block of one of the plurality of segments; and calculating a pixel-based backlight intensity of the target pixel by performing pixel interpolation to a plurality of block-based backlight intensities of a plurality of blocks around the target block where the target pixel locates.

17. The electronic device of claim 16, wherein calculating the pixel-based boosting ratio corresponding to the target pixel according to the sub-pixel values of the target pixel comprises:

providing a chromatic luminance of the target pixel corresponding to a hue;

calculating the chromatic luminance of the target pixel; and calculating the pixel-based boosting ratio corresponding to the target pixel according to the human eye sensing capability parameter corresponding to the target pixel.

18. The method of claim 16, wherein the human eye sensing capability parameter is a HK (Helmholtx-Kohklrausch) effect parameter, and the HK effect parameter results from different sensing capability of human eyes for different colors.

19. The electronic device of claim 17, wherein the human eye sensing capability parameter of the target pixel is obtained according to at least one of a saturation, a maximum among the sub-pixel values, and a maximum chromatic luminance of the target pixel corresponding to the hue.

20. The electronic device of claim 17, wherein calculating the pixel-based boosting ratio corresponding to the target pixel according to the human eye sensing capability parameter corresponding to the target pixel comprises:

converting the sub-pixel values of the target pixel into converted sub-pixel values of the target pixel;

calculating a transmittance effect parameter corresponding to the target pixel according to the sub-pixel values and the converted sub-pixel values, wherein the transmittance effect parameter is used to compensate differences between transmittances of the target pixel and another pixel of different colors; and calculating the pixel-based boosting ratio corresponding to the target pixel based on the human eye sensing capability parameter of the target pixel and the transmittance effect parameter corresponding to the target pixel.

21. The electronic device of claim 20, wherein converting the sub-pixel values of the target pixel into converted sub-pixel values of the target pixel comprises:

converting the red, green, blue sub-pixel values of the target pixel from a first format into a second format, wherein the target pixel with the second format comprises red, green, blue and white sub-pixel values, and the converted sub-pixel values comprises converted red, green, blue sub-pixel values;

calculating the converted red sub-pixel value based on the red and white sub-pixel values with the second format, the converted green sub-pixel value based on the green and white sub-pixel values with the second format, and the converted blue sub-pixel value based on the blue and white sub-pixel values with the second format.

22. The electronic device of claim 17, wherein calculating the pixel-based boosting ratio corresponding to the target pixel according to the sub-pixel values of the target pixel comprises:

converting the target pixel from a first format into a second format by performing an RGB-to-RGBW conversion process, wherein the target pixel with the second format comprises red, green, blue and white sub-pixel values; and calculating the pixel-based boosting ratio corresponding to the target pixel according to the human eye sensing capability parameter, a first luminance of the target pixel with the first format and a second luminance of the target pixel with the second format;

wherein the pixel-based boosting ratio corresponding to the target pixel is calculated based on a first function of the human eye sensing capability parameter and the first luminance of the target pixel with the first format and a second function of the human eye sensing capability parameter and the second luminance of the target pixel with the second format.

23. The electronic device of claim 16, wherein calculating the pixel-based boosting ratio corresponding to the target pixel according to the sub-pixel values of the target pixel comprises:

converting a chromatic luminance of the target pixel corresponding to a hue into the human eye sensing capability parameter of the target pixel; and calculating the pixel-based boosting ratio corresponding to the target pixel according to the human eye sensing capability parameter corresponding to the target pixel.

24. The method of claim 23, wherein the human eye sensing capability parameter is a HK (Helmholtx-Kohklrausch) effect parameter, and the HK effect parameter results from different sensing capability of human eyes for different colors.

25. The electronic device of claim 23, wherein the human eye sensing capability parameter of the target pixel equals 1 and a maximum among the sub-pixel values multiplied with a difference between a maximum chromatic luminance and the chromatic luminance of the target pixel.

26. The electronic device of claim 23, wherein the pixel-based boosting ratio of the target pixel is a multiplication of the sub-pixel values and the human eye sensing capability parameter of the target pixel.

27. The electronic device of claim 16, wherein adjusting both the backlight duty associated with the target pixel according to the pixel-based boosting ratio comprises:

dividing the image frame into a plurality of non-overlapping blocks, wherein a segment of the image frame is associated with one or a group of the plurality of non-overlapping blocks;

wherein the plurality of non-overlapping blocks comprise the target block, and the plurality of pixels of the target block comprises the target pixel; and calculating a respective final duty cycle corresponding to the target block according to the block-based boosting ratio and a segmental local dimming duty corresponding to the target block.

28. The electronic device of claim 27, wherein adjusting both the backlight duty associated with the target pixel according to the pixel-based boosting ratio further comprises:

calculating the segmental local dimming duty corresponding to the target block according to a maximum of sub-pixel values for the plurality of pixels of the target block.

29. The electronic device of claim 16, wherein adjusting the sub-pixel values of the target pixel according to the pixel-based boosting ratio comprises:

calculating a final pixel-based gain of the target pixel according to the pixel-based boosting ratio and the pixel-based backlight intensity of the target pixel; and compensating the sub-pixel values of the target pixel according to the final pixel-based gain to generate a plurality of compensated sub-pixel values of the target pixel;

wherein the pixel-based backlight intensity is calculated based on contributions of one or a plurality of backlight sources associated with a segment of the image frame where the target pixel is located.

30. The electronic device of claim 16, wherein adjusting the sub-pixel values of the target pixel according to the pixel-based boosting ratio comprises:

calculating a final pixel-based gain of the target pixel according to an output of the plurality of segmental backlight duties and the light spread profile of the plurality of segments of the image frame.

* * * * *